US005974698A

United States Patent [19]

Nash et al.

[11] Patent Number: 5,974,698

[45] **Date of Patent: *Nov. 2, 1999**

[54] OVERSHOE CONSTRUCTION

[75] Inventors: W. Woodward Nash; Scott D. Hardy, both of Charlotte, Vt.

[73] Assignee: New England Overshoe Company, Inc., Charlotte, Vt.

[ * ] Notice: This patent issued on a continued prosecution application filed under 37 CFR 1.53(d), and is subject to the twenty year patent term provisions of 35 U.S.C. 154(a)(2).

[21] Appl. No.: 08/979,970

[22] Filed: Nov. 26, 1997

[51] Int. Cl.[6] ..... A43B 1/14; A43B 3/16

[52] U.S. Cl. ..... 36/87; 36/7.3; 36/7.1 R

[58] Field of Search ..... 36/87, 7.3, 7.1 R, 36/10, 4

[56] References Cited

U.S. PATENT DOCUMENTS

| | | |
|---|---|---|
| 296,495 | 4/1884 | Williamson . |
| 508,619 | 11/1893 | Hurd . |
| 797,966 | 8/1905 | Lange et al. . |
| 1,947,173 | 2/1934 | Riley . |
| 2,458,438 | 1/1949 | Snelling . |
| 2,507,726 | 5/1950 | L'Hollier et al. . |
| 3,286,375 | 11/1966 | Troy . |
| 3,373,512 | 3/1968 | Jacobson . |
| 3,645,017 | 2/1972 | Hickmann . |
| 3,657,757 | 4/1972 | Vilder . |
| 3,805,419 | 4/1974 | White . |
| 3,981,088 | 9/1976 | Mitchell et al. . |
| 4,060,918 | 12/1977 | Mandel . |
| 4,099,341 | 7/1978 | Gibson . |
| 4,154,009 | 5/1979 | Kubelka et al. . |
| 4,268,931 | 5/1981 | Salomon . |
| 4,301,603 | 11/1981 | Scott . |
| 4,434,565 | 3/1984 | Haley . |
| 4,499,675 | 2/1985 | Perotto . |
| 4,708,810 | 11/1987 | Massengale . |
| 4,825,564 | 5/1989 | Sorce . |
| 4,893,417 | 1/1990 | Dalla Lana . |
| 4,896,438 | 1/1990 | DeBease . |
| 4,908,960 | 3/1990 | Hoyt, Jr. . |
| 5,056,240 | 10/1991 | Sherrill . |
| 5,106,445 | 4/1992 | Fukuoka . |
| 5,499,459 | 3/1996 | Tomaro . |
| 5,600,901 | 2/1997 | Leonor . |
| 5,604,997 | 2/1997 | Dieter . |

*Primary Examiner*—Ted Kavanaugh
*Attorney, Agent, or Firm*—Fish & Richardson P.C.

[57] ABSTRACT

An article of footwear (e.g., shoe, boot or overshoe) includes an upper including at least a portion formed of a compression-molded body. The body generally is formed as a laminate having a thermally insulating foam layer. The compression molded body can form the forepart of the upper (i.e., the vamp), the heel region, the tongue, or any combination of these parts of the footwear. An overshoe having such a vamp portion may include an inner polishing layer to polish the dress shoe during walking.

11 Claims, 2 Drawing Sheets

OVERSHOE CONSTRUCTION

BACKGROUND OF THE INVENTION

The invention relates to footwear.

Overshoes, including galoshes, are used to protect a wearer's shoes, particularly in mud, snow or slush. Snow or slush (including salt commonly used to melt the snow or slush) can damage the shoes, particularly when they are made of leather. Overshoes are typically constructed of molded rubber or plastic having sufficient flexibility to allow the overshoe to be pulled over a shoe within a range of shoe sizes.

In use, overshoes are typically constructed to be slipped over the toe of the shoe with one or both hands and then stretched over the heel.

SUMMARY OF THE INVENTION

The invention relates in general to articles of footwear having a portion formed of a compression-molded body laminate. The articles of footwear are of the type having a sole and an upper which together protect and define a volume for receiving a wearer's foot.

In one aspect of the invention, the article of footwear is an overshoe having a sole and an upper which together protect and define a volume for receiving a wearer's dress shoe. In another aspect of the invention, the article of footwear is a shoe or boot.

Preferred embodiments of both aspects of the invention may include one or more of the following features. The molded body is a laminate including a thermally-insulated foam plastic layer, such as polyethylene or ethyl vinyl acetate (EVA) foam. In some embodiments, the thermally-insulated foam plastic layer is formed of a waterproofing layer. In other embodiments the laminate includes an outermost waterproofing layer formed of a water impervious material such as polyvinyl chloride, polyurethane, or waterproof leather.

The compression-molded body can be the forepart of an upper (i.e., the vamp portion), a heel region, the tongue, or any combination of these parts.

In the overshoe embodiment, the body further includes an inner polishing layer formed, for example brushed polyester, to polish the dress shoe during walking.

The invention, in general, provides a lightweight, resilient and durable footwear article for protecting a wearer's foot or dress shoe, particularly in inclement weather conditions. The overshoe also provides more warmth to the wearer's foot than injection, pour, or slush molded, rubber overshoes.

In another aspect of the invention, an article of footwear has a portion formed of a vacuum-formed body laminate.

Other advantages and features of the invention will become apparent from the following description of presently preferred embodiments, and from the claims.

DESCRIPTION

Figure 1:
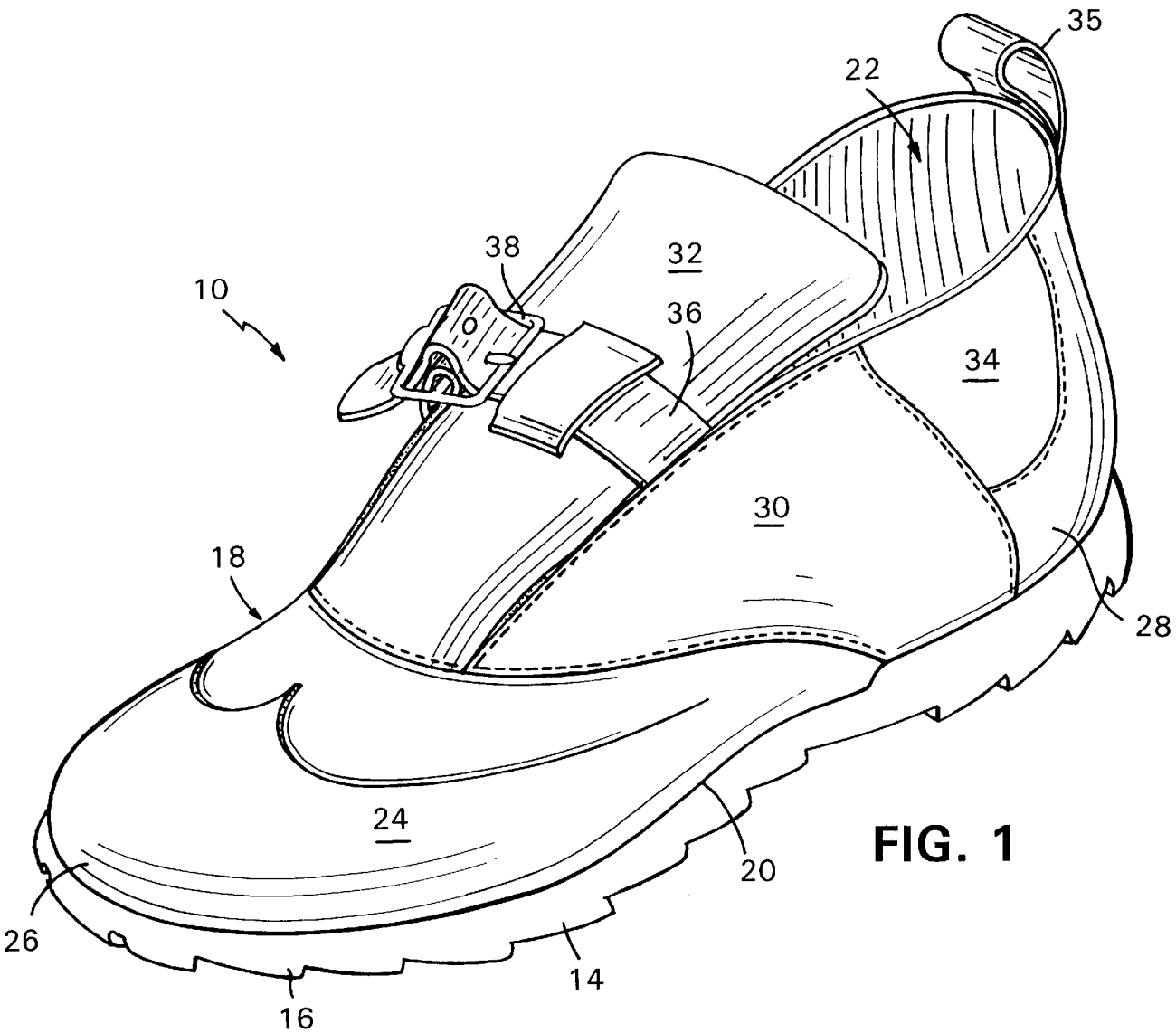
FIG. 1 is a perspective view of an overshoe of the invention and a shoe to be received within the overshoe.

Referring to FIG. 1, a lightweight, resilient, and durable overshoe 10 generally sized and shaped to receive a shoe (not shown), for example, a wingtip dress shoe, which is desired to be protected during walking in inclement weather. Overshoe 10 has an outsole 14, formed of a molded elastomeric material (e.g., rubber or polyurethane), having an integrally molded raised tread or lugs 16 to increase traction when walking over slippery or difficult surfaces. An upper 18 is attached along a periphery 20 of outsole 14 so that the upper and outsole together define a volume 22 for receiving the foot-wearing shoe. Upper 18 includes a vamp portion 24 which essentially forms the entire forepart of the upper. In particular, vamp portion 24 extends from a toe region 26 and along the side of the upper to a heel region 28 of the upper.

Side support panels 30 and a tongue 32 extend proximally from vamp portion 24 toward heel region 28. A stretchable elastic-like material 34 spans side support panel 30 and heel region 28 to facilitate pulling overshoe 10 over the dress shoe. A looped tab 35 is attached to the rear collar portion of heel region 28 to facilitate insertion of the dress shoe within the overshoe or removal of the bootie from the dress shoe. Tongue 32 includes a strap 36 and buckle 38 for securing the dress shoe within overshoe 10.

Figure 2:
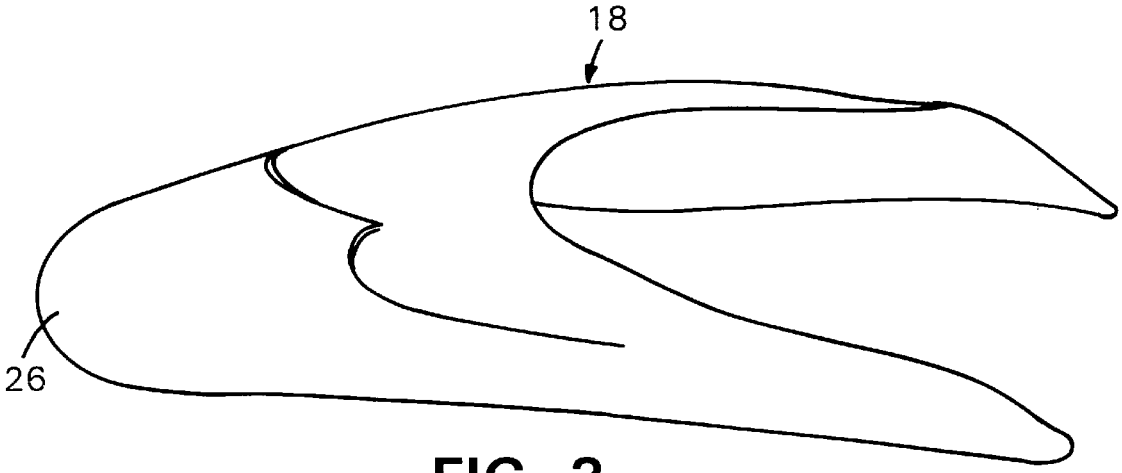
FIG. 2 is a perspective view of the vamp portion of the overshoe of FIG. 1.

Referring to FIG. 2, vamp portion 24 (shown apart from the remainder of the upper) has substantially the same wingtip-shaped, sweeping appearance as that of a wingtip dress shoe, thereby providing a stylish look to the overshoe.

Vamp portion 24 is fabricated as a compression-molded laminate 40 including a body 42 of closed cell foam plastic (e.g., polyethylene, ethyl vinyl acetate) which has sufficient formability and resilience to recover its shape after being deformed while also providing thermal insulation to the wearer's foot. The material used to form body 42 can also provide waterproof protection. During compression-molding, the laminate is heated to a generally pliable condition with the thickness of various areas of the body being dependent on the level of compression-molding applied to the area.

In particular embodiments, compression-molded laminate 40 also includes a relatively thin waterproof layer 44 on an outer surface. Waterproof layer 44 is formed of a material which is impervious to penetration by water including, for example, polyvinyl chloride, polyurethane, or waterproof leather. Waterproof layer 44 provides additional waterproofing protection to vamp portion 24 as well as an overall aesthetically appealing appearance to the overshoe. Laminate 40 also includes an inner, shoe-surface protective material 46 formed of a relatively soft, fleece-like material (e.g., felt), which provides comfort to the wearer and protects the dress shoe. Inner protective material 46 also provides the added benefit of polishing the shoe during walking.

Other embodiments are within the following claims. For example, heel region 28, side support panels 30, and tongue 32 (FIG. 1) may all be formed of the same laminate used to form vamp portion 24. Thus, as described above, these parts would include a body of closed cell foam plastic, a waterproof layer and an inner, shoe-surface protective layer formed of a relatively soft material for protecting and polishing the shoe during walking. A combination of stitching, adhesive tape, or glue can be used to join and provide a waterproof seal between the individual parts.

In an alternative embodiment, laminate 40 may be provided using a vacuum-forming process. Although the laminate may be formed using a vacuum-forming process alone, combining this process with a compression-molding process is particularly useful in applications where sharp ridges or creases on the surface of the body are desired.

Other attachment arrangements may also be substituted for strap 36 and buckle 38 of tongue 32 for securing the dress shoe within overshoe 10, including corresponding, mating fasteners formed of patches of hook-and-loop type fabric closure materials such as those sold under the trademark VELCRO®.

Figure 3:
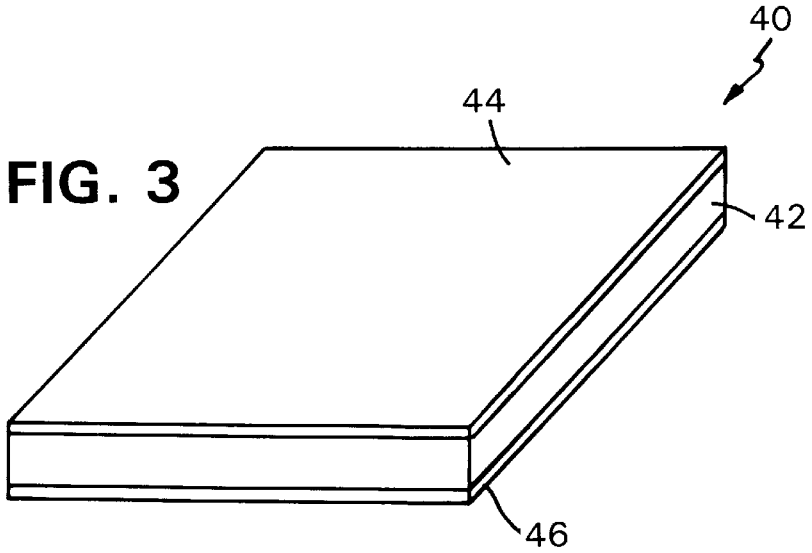
FIG. 3 is a cross-sectional view showing layers of the vamp portion of the overshoe of FIG. 1.

Although the embodiment described above in conjunction with FIGS. 1–3 is directed to an overshoe, it is also appreciated that the invention is equally applicable to other forms of footwear including shoes, boots and slippers.

What is claimed is:

1. An overshoe of the type worn over a shoe, the overshoe comprising:

a sole including a bottom surface having protuberances formed thereon, the protuberances shaped and sized to improve traction with a walking surface;

an upper attached to the sole, the upper and sole together defining a volume for receiving and protecting a shoe, the upper including:

a side support panel and a heel support panel; and an intermediate portion, spanning the side support panel and heel support panel, formed of a non-compression molded, stretchable elastic-like material to facilitate placing the overshoe over the shoe;

a vamp portion formed of a compression-molded laminate body having a waterproof layer, the vamp portion extending from a toe region of the upper to the side support panel.

2. The overshoe of claim 1 wherein the compression molded laminate body of the vamp portion includes a thermally-insulated foam plastic layer.

3. The overshoe of claim 2 wherein the foam plastic layer is formed of a waterproofing material.

4. The overshoe of claim 2 wherein said thermally insulating foam layer is formed of a polyethylene foam.

5. The overshoe of claim 2 wherein the laminate further comprises an outermost waterproof layer.

6. The overshoe of claim 5 wherein said waterproof layer is formed of polyvinyl chloride.

7. The overshoe of claim 2 wherein said laminate further includes an inner polishing layer.

8. The overshoe of claim 7 wherein said inner polishing layer is formed of brushed polyester.

9. The overshoe of claim 1 wherein said upper further includes a tongue having a compression-molded body.

10. The overshoe of claim 1 wherein the side support panel and heel support panel are formed of a non-compression molded material.

11. The overshoe of claim 1 wherein the protuberances include integrally molded raised treads.

* * * * *